US011624596B2

(12) United States Patent
Paulic et al.

(10) Patent No.: US 11,624,596 B2
(45) Date of Patent: Apr. 11, 2023

(54) SUPERCAVITATING CARGO ROUND

(71) Applicant: Advanced Acoustic Concepts, LLC, Washington, DC (US)

(72) Inventors: Antonio Paulic, Westerville, OH (US); John Granier, Round Rock, TX (US); John Walter Rapp, Manassas, VA (US)

(73) Assignee: Advanced Acoustic Concepts, LLC, Hauppauge, NY (US)

( * ) Notice: Subject to any disclaimer, the term of this patent is extended or adjusted under 35 U.S.C. 154(b) by 497 days.

(21) Appl. No.: 16/739,608

(22) Filed: Jan. 10, 2020

(65) Prior Publication Data

US 2021/0278180 A1 Sep. 9, 2021

Related U.S. Application Data

(60) Provisional application No. 62/790,930, filed on Jan. 10, 2019.

(51) Int. Cl.

| | |
|---|---|
| ***F42B 15/22*** | (2006.01) |
| ***F42C 17/04*** | (2006.01) |
| ***F42C 15/40*** | (2006.01) |
| ***F42C 19/06*** | (2006.01) |
| ***F42B 12/20*** | (2006.01) |
| ***F41H 11/12*** | (2011.01) |
| ***F42B 12/44*** | (2006.01) |
| *F42B 10/52* | (2006.01) |
| *F42B 12/58* | (2006.01) |

(52) U.S. Cl.

CPC ..... *F42B 15/22* (2013.01); *F41H 11/12* (2013.01); *F42B 12/20* (2013.01); *F42B 12/44* (2013.01); *F42C 15/40* (2013.01); *F42C 17/04* (2013.01); *F42C 19/06* (2013.01); *F42B 10/52* (2013.01); *F42B 12/58* (2013.01)

(58) Field of Classification Search

CPC ..... F42B 10/46; F42B 10/52; F42B 12/08; F42B 12/20; F42B 12/44; F42B 12/58; F42B 15/20; F42B 15/22; F42B 17/00; F42C 11/00; F42C 11/001; F42C 11/005; F42C 11/06; F42C 11/065; F42C 15/40; F42C 17/04; F42C 19/06; F42C 19/07; F42C 19/12; F41H 11/12

USPC ..... 102/390, 391, 392, 393, 396, 399, 402; 89/1.13, 6, 6.5; 114/20.1–25

See application file for complete search history.

(56) References Cited

U.S. PATENT DOCUMENTS 5,929,370 A * 7/1999 Brown ..... F42B 15/22 102/501

5,955,698 A * 9/1999 Harkins ..... F42B 10/46 102/390

(Continued)

OTHER PUBLICATIONS

R. L. Waid, "Forces on Composite Bodies in Full Cavity Flow,", Sep. 1, 1957, California Inst. Tech., Report No. E-73.8, 35 pp., https://authors.library.caltech.edu/57820/.

*Primary Examiner* — James S Bergin

(74) *Attorney, Agent, or Firm* — Kaplan Breyer Schwarz, LLP

(57) ABSTRACT

A supercavitating cargo round comprises an energetic payload and an electronic payload. The electronic payload includes programmable circuitry suitable for implementing a digital delay of arbitrary length. The supercavitating cargo round is programmable while in a barrel or loader of a weapon.

20 Claims, 10 Drawing Sheets

(56) References Cited

U.S. PATENT DOCUMENTS

| | | | | |
|---|---|---|---|---|
| 6,405,653 | B1 * | 6/2002 | Miskelly | F42B 15/20 89/1.807 |
| 6,540,175 | B1 * | 4/2003 | Mayersak | F42B 12/60 89/1.13 |
| 7,343,860 | B2 * | 3/2008 | Michel | F42C 1/04 102/254 |
| 7,503,259 | B2 * | 3/2009 | Howard | F42B 21/00 114/21.3 |
| 7,779,759 | B2 | 8/2010 | Paulic et al. | |
| 7,832,336 | B2 * | 11/2010 | Fu | F42B 17/00 114/20.1 |
| 7,836,827 | B2 * | 11/2010 | Fu | F42B 17/00 114/20.1 |
| 8,042,471 | B2 * | 10/2011 | Michel | F42C 15/20 102/254 |
| 8,047,135 | B1 | 11/2011 | Paulic et al. | |
| 8,082,847 | B1 * | 12/2011 | Fu | F42B 19/125 114/20.1 |
| 8,146,501 | B1 * | 4/2012 | Fu | F42B 10/38 114/20.1 |
| 8,151,710 | B2 | 4/2012 | Fu et al. | |
| 8,245,645 | B1 * | 8/2012 | Paulic | F42B 12/22 102/497 |
| 8,438,977 | B2 * | 5/2013 | Paulic | F42B 14/00 244/3.27 |
| 11,073,369 | B2 * | 7/2021 | Paulic | F42C 17/04 |

* cited by examiner

SUPERCAVITATING CARGO ROUND

STATEMENT OF RELATED CASES

This specification claims priority of U.S. patent application Ser. No. 62/790,930 filed Jan. 10, 2019, and which is incorporated by reference herein.

FIELD OF THE INVENTION

The present invention relates to high-speed underwater projectiles.

BACKGROUND

Underwater gun systems are being developed for naval warfare. These systems often use an energetic propellant to launch a projectile from a launch tube. A challenge to developing effective underwater guns is that a projectile traveling through water experiences a resistance or drag that is approximately one thousand times greater than the resistance experienced by the projectile traveling through air. As a consequence of this high level of drag, conventional underwater projectiles are limited to speeds of no more than about 80 km/h.

The high resistance presented by the water medium can be addressed via a phenomenon known as "supercavitation." This phenomenon can occur when a projectile having a blunt nose and a streamlined, hydrodynamic, and aerodynamic body travels at sufficiently high speeds under water. The blunt nose pushes aside water as the projectile advances. When the hydrodynamic pressure of water that is pushed aside overcomes the ambient static pressure, the water evacuates a cavity, and some of the water evaporates into the vacuum of the cavity. This typically occurs at speeds in excess of about 100 miles per hour. Supercavitation is defined to occur when the water forms a sustainable "cavity" that does not impinge upon the body of the projectile, with the exception of the blunt tip of the nose. The primary source of drag is upon the blunt tip, which is due to the ramming force that pushes aside the water. There are other sources of drag that depend on the quality of the cavity. For example, in a compact cavity, there will be more droplets that impinge on the body of the projectile, thus increasing the drag. This characterizes the supercavitating mode of operation.

Within the vaporous cavity, the supercavitating projectile is effectively traveling—flying—through air rather than water. The projectile therefore experiences greatly reduced drag; mostly the ram drag on the blunt nose. As a consequence, the projectile is capable of attaining a velocity far in excess of what is possible when traveling through water when the body wetted. Also, for a given amount of thrust, a supercavitating object can travel at far greater speeds and further than an object that is moving in a conventional manner through water. In the absence of sustaining propulsion, the moving object loses supercavitation and eventually stalls due to body drag when the cavity impinges upon the body of the projectile.

SUMMARY OF THE INVENTION

The illustrative embodiment is a non-self-propelled, supercavitating cargo round (SCR). In accordance with the illustrative embodiment, the cargo of the SCR comprises a programmable electronic payload and an energetic payload. The energic payload comprises an energetic material, such as a high explosive, incendiary material, or a reactive composition. In some embodiments, the electronic payload includes programmable safe and arm electronics, such as satisfy the Federal Government's safety criteria for fuzes, as provided in MIL-STD-1316F. Or the electronic payload can be programmed to satisfy the safety requirements (or other requirements) of other countries. In some embodiments, the electronic payload comprises a programmable electronic delay.

Most prior-art supercavitating rounds are kinetic projectiles; that is, they do not carry any energetic material (e.g., explosives, incendiary material, etc.). See, for example, U.S. Pat. Nos. 7,779,759 and 8,151,710. On the other hand, U.S. Pat. No. 8,047,135 discloses a supercavitating round—a dart—that includes energetic material; in particular, a high-explosive payload. In addition to the high explosive, the dart includes two time-delay, chemical fuses. One of the chemical fuses has a relatively shorter delay of about 500 microseconds. This shorter delay triggers when the dart impacts the casing of a mine, allowing time for the dart and its high-explosive payload to penetrate the casing and reach the mine's explosive payload. The other of the fuses has a relatively longer delay of about 1 second. This longer delay triggers when the dart impacts water, sand, or soil. Assuming that dart penetrates water on its way to a mine, the dart and mine will typically explode before the longer delay expires. However, if the dart does not impact a mine, the second delay will expire and trigger the dart's explosive payload. This prevents unexploded darts from littering the area, which would pose an extreme risk to civilians, particularly children. Furthermore, explosive material recovered from unexploded darts could be used by enemy combatants to create improvised explosive devices.

The present inventors recognized that if an in-the-barrel (single-shot weapon) or in-the-loader (multi-shot weapon) programmable electronic payload, such as programmable safe-and-arm electronics, and/or a programmable electronic delay/timer could be incorporated into a supercavitating round, it would imbue the round with substantial tactical advantages relative to prior-art supercavitating rounds. And of course, for use by the U.S. military, such a round requires safe-and-arm electronics.

In particular, modern chemical delays, especially those suitable for small munitions such as those germane to the present invention, can provide only a very brief period of delay (i.e., seconds). In accordance with some embodiments of invention, circuitry incorporated into the electronics payload can provide one or more arbitrarily long (i.e., fractions of a second to days) delays, or a specific time for triggering, which can be programmed until such time that the SCR is fired from a weapon.

Consider, for example, an attacking force that must pass through a field of underwater mines prior to reaching land. The attacking force will want to keep their presence undetected for as long as possible. If prior-art supercavitating projectiles were used to explode the mines prior to passage, the mines would likely have to be detonated one at time, betraying the presence of the attacking force. In accordance with the present teachings, a single delivery platform (e.g., a single unmanned underwater vehicle, etc.) could be used to fire SCRs, one-at-a-time, into a group of mines that, when exploded, would provide a clear path to land. These SCRs can be preprogrammed to trigger at a set time or with an appropriately long delay that provides enough time for SCRs to be fired into all mines of the group. In this fashion, the SCRs, and hence the mines, are triggered at the last possible moment prior to the beach landing.

In-the-barrel or in-the-loader programmability provides mission flexibility, particularly for a SCR being fired from an unmanned underwater vehicle (UUV). For example, an attacking force might not know what particular countermeasures they may face until shortly before actual engagement. Once such information is obtained, the electronic payload can be suitably programmed (e.g., for a specific casing or hull thickness, for a specific gap thickness between a casing/hull and the internals being targeted, etc.). Programming can be performed either by an operator controlling the UUV, or by the UUV itself when operating autonomously, such as by using a look-up table that provides triggering delays, etc., as a function of the target.

The supercavitating rounds to which the present invention are directed are small, usually having a diameter of less than about 40 millimeters (mm). The illustrative embodiment is directed to a SCR having a diameter of 20 mm. It is this small diameter that presents a major challenge to the design of the SCR. That is, such a small SCR is extremely space constrained. Consequently, having to incorporate an electronic payload, an energetic payload, and a non-wireless interface that enables programming the SCR in-the-barrel (or in-the-loader), while meeting the requirements for creating and maintaining supercavitating transit in a round that is robust enough to penetrate inch-thick hulls or mine casings, presents an extreme design challenge.

DETAILED DESCRIPTION

Embodiments of the invention pertain to a supercavitating cargo round. As used herein, the term "supercavitating cargo round" (or SCR) refers to a projectile that is not self-propelled, and explicitly includes any such self-propelled supercavitating projectiles, regardless of the source of the propulsion (e.g., chemical, motor, etc.). A supercavitating torpedo, for example, is not a supercavitating cargo round as that term is used herein and in the appended claims.

Figure 1:
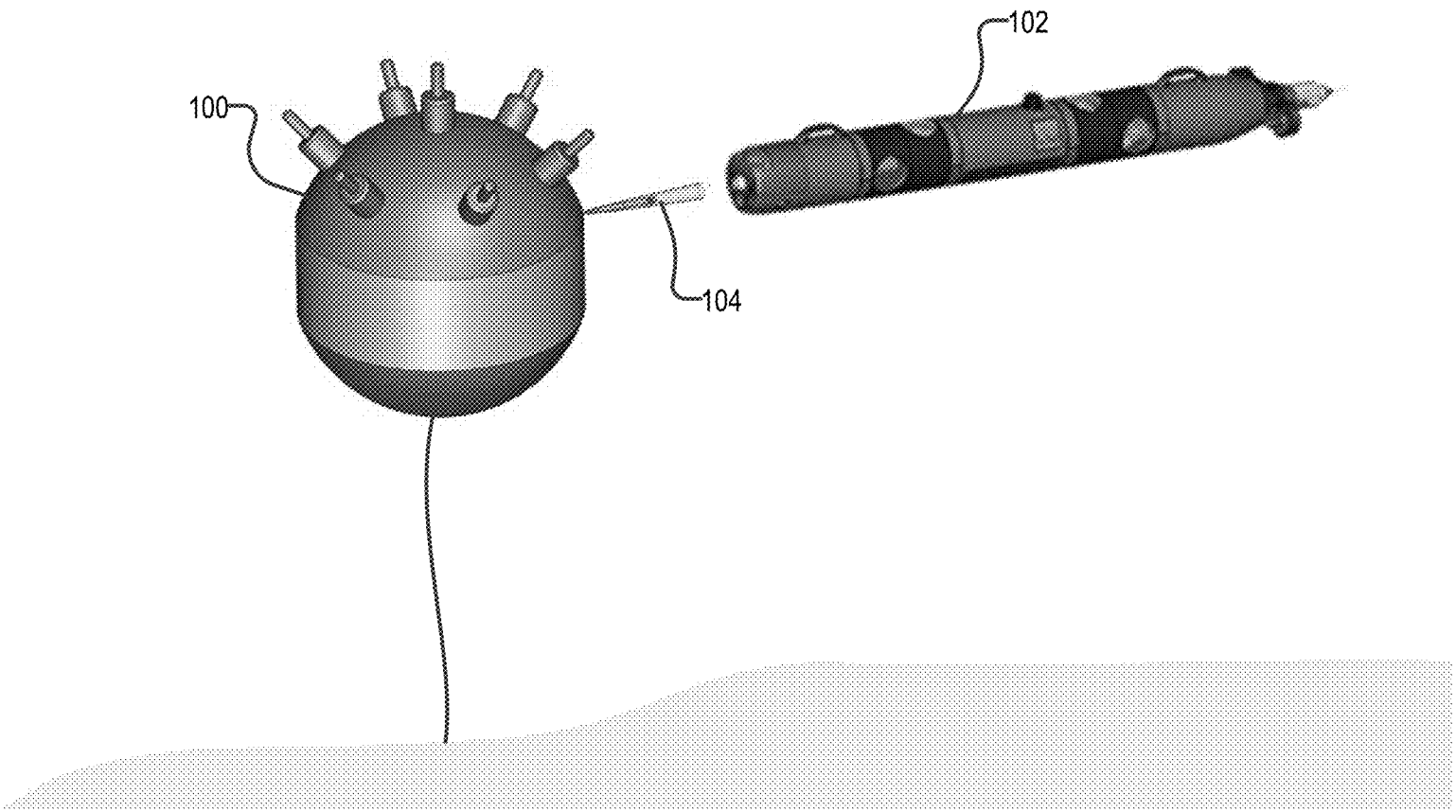
FIG. 1 depicts a concept of operations for the supercavitating cargo round, wherein the cargo round is fired at a sea mine from a weaponized UUV.

FIG. 1 depicts a concept of operations for the SCR. In the pictured embodiment, SCR 104 is fired from UUV 102 toward tethered underwater mine 100. In the illustrative embodiment, UUV 102 includes a barrel that fires a single SCR at a time. The barrel must be manually reloaded after firing. In some other embodiments, the SCR is fired from a multi-shot weapon, which can be located (a) on a UUV, (b) on a stationary platform that can be positioned on the seabed, or (c) on a vessel, and which deploys below the waterline from the hull of vessel.

Figure 2:
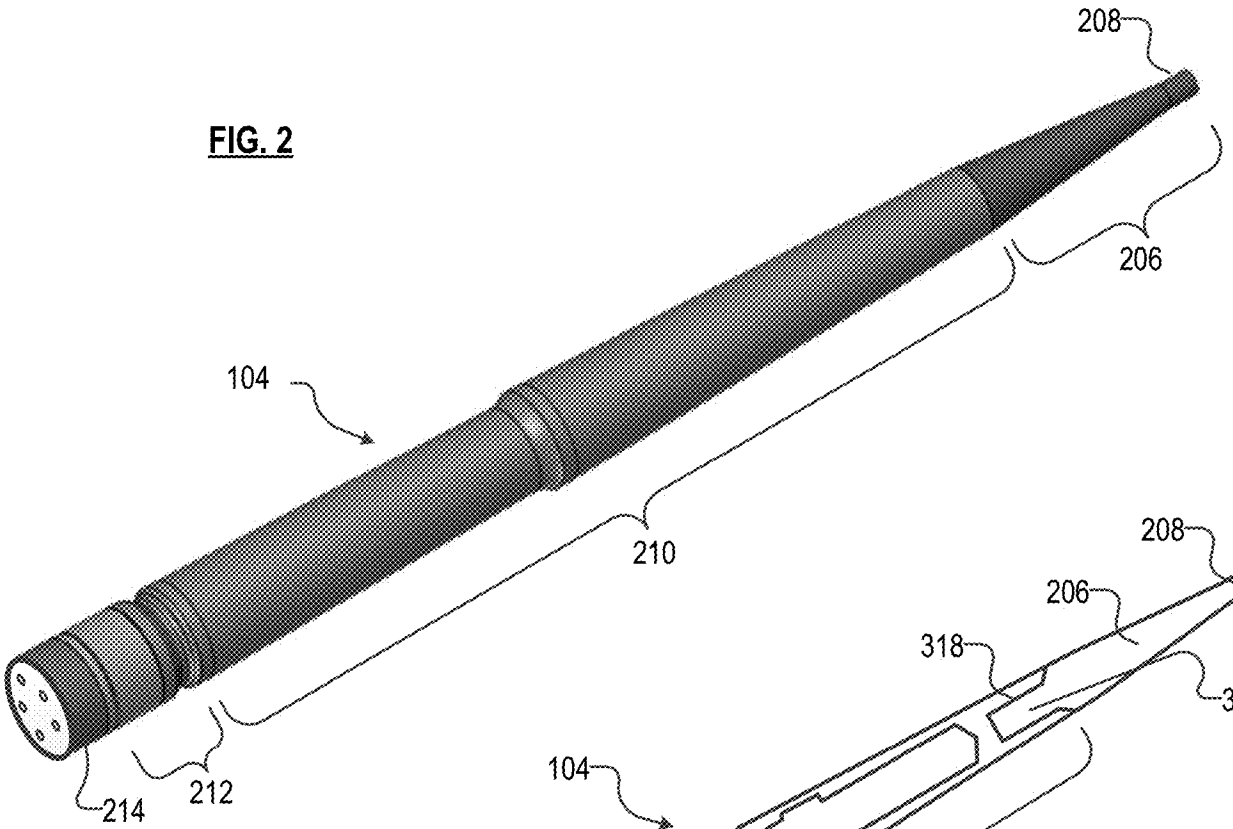
FIG. 2 depicts a perspective view of a supercavitating cargo round in accordance with an illustrative embodiment of the invention.

FIG. 2 depicts a perspective view of SCR 104 in accordance with the illustrative embodiment of the invention. The externally visible portions of SCR 104 include nose (or "nose penetrator") 206, body 210, cap 212, and cap insulator 214, configured as shown.

Because it is required to penetrate the hull of a target, which might be steel having a thickness of about ½ inch or more, nose 206 must be made of a high-density material having good material properties such that it maintains its structural integrity on target impact. Important material properties include tensile strength, Charpy impact, and density. In the illustrative embodiment, the nose comprises heavy tungsten, which is alloy having a high tungsten content (c.a., 90 percent or more), with the balance being metals such as nickel, iron, molybdenum, and the like.

The forward edge of nose 206 is blunt. In conjunction with the velocity of the cargo round, this blunt edge creates a vaporous cavity. Specifically, at sufficient speed, water is forced off of the blunt leading edge of nose 206 with such speed and at such an angle, that the water avoids hitting the body of SCR 104. Therefore, instead of being encased by water, SCR 104 is surrounded by an ellipsoidal region of water vapor. Although the blunt forward edge has a high drag coefficient, the greatly reduced overall water-contact area drastically reduces the overall drag of SCR 104. Consequently, SCR 104 retains greater velocity and travels further underwater than a non-supercavitating round.

To retain velocity as effectively as possible, the blunt forward edge of the nose should be as small as possible while still producing a cavity that completely avoids hitting the body of SCR 104. In some embodiments, such as that shown in FIG. 2, the leading edge of tip 208 is flat and oriented orthogonally to the long axis of SCR 104. In some other embodiments, the forward edge of tip 208 is slightly concave. As a consequence of its contribution to the creation of the cavity, tip 208 of a supercavitating projectile is typically referred to as a "cavitator." As such, the terms "tip" (of the nose) and "cavitator" are used synonymously herein.

Tip 208, which represents a relatively small portion of nose 206, has a cylindrical shape. Aft of tip 208, the external surface of nose 206 smoothly and gently tapers from a minimum diameter—that of the tip—to a maximum diameter wherein nose 206 integrates with body 210.

Diameter of body 210 increases from a minimum at the intersection with nose 206 to a maximum near the midpoint of the length of SCR 104. This form factor conforms to the predicted shape of the supercavitating cavity, and reduces drag when SCR 104 impinges water at the interface between the cavity and the enveloping water. In some embodiments, the aft portion of body 210 includes adaptations for enhancing hydrodynamic stability and arresting the payload within the target. Such adaptations can include, without limitation, fins, flaring of the diameter, and the like. In some embodiments, body 210 comprises high-strength steel.

Cap 212 seals the aft end of body 210. In the illustrative embodiment, cap 212 comprises titanium. As discussed in more detail in conjunction with FIGS. 3-5 and 6B, in the illustrative embodiment, cap 212 is implemented as two pieces. Cap insulator 214 is an electrical interface between SCR 104 and elements external thereto. The cap insulator comprises an electrically insulating material (i.e., a material that is not electrically conductive), such as polyether ether ketone (PEEK). Cap insulator 214 is discussed in more detail in conjunction with FIG. 5.

Figure 3:
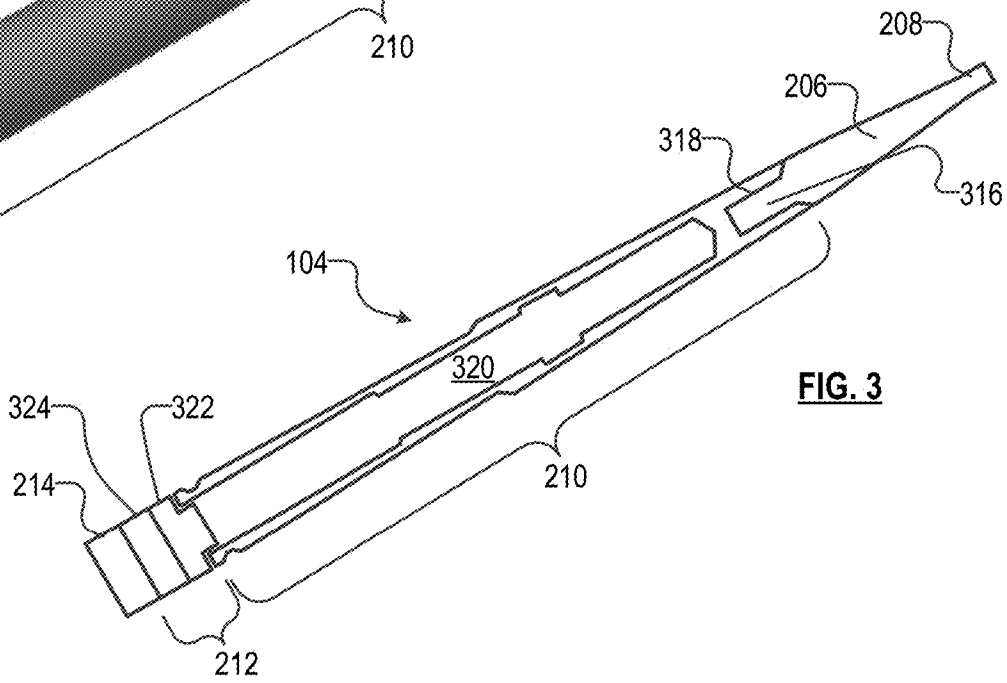
FIG. 3 depicts a cross-sectional view of the supercavitating cargo round of FIG. 2.

Referring now to FIG. 3, body 210 has thick walls that enclose cavity 320. As discussed further in conjunction with FIGS. 3-5, cavity 320 defines a payload compartment. The forwardmost portion of body 210 includes recess 318 for receiving protuberance 316 of nose 206, thereby providing structural rigidity to SCR 104.

In the illustrative embodiment, recess 318 and protuberance 316 are cooperatively sized so they physically couple to one another via a press fit. In this embodiment, nose 316 is not adhered/bonded to body 210. In some embodiments, a weak adhesive is used. In either case, as described in further detail later in this specification, this tentative coupling enables nose 206 to detach from body 210 after impact with a target. This reduces the inertia of the payload, which assists in arresting the "energetic" payload in the target.

FIG. 3 shows cap 212 as being composed of two parts: first part 322, which couples to the aft end of body 210, and second part 324, which couples to first part 322.

Figure 4:
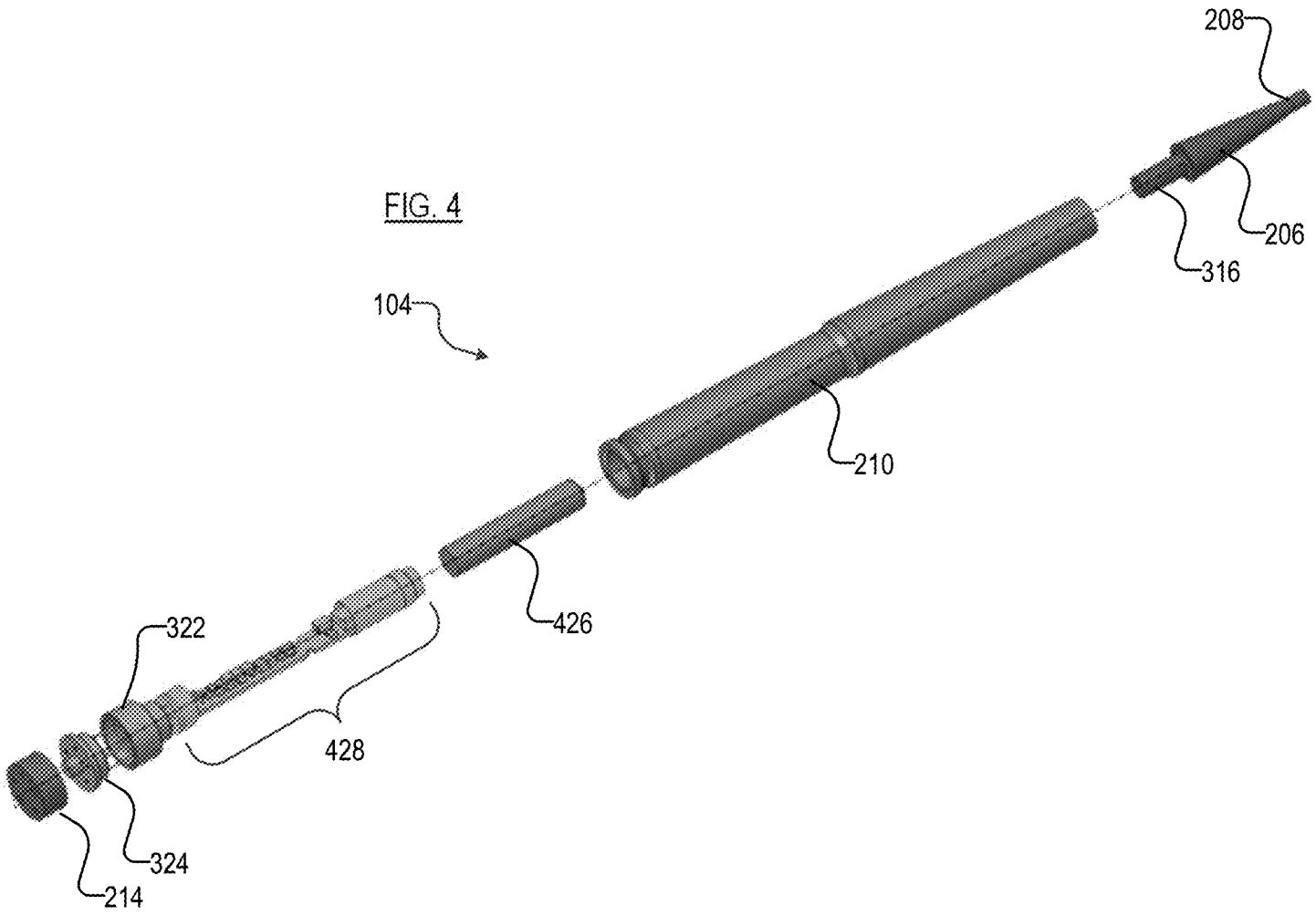
FIG. 4 depicts an exploded perspective view of the cargo round of FIG. 2.

FIG. 4 depicts an "exploded" view of SCR 104. The salient features of this Figure are energetic payload 426 and electronic payload 428, which are contained in cavity or payload compartment 320 of body 210.

In the illustrative embodiment, energetic payload 426 is a high-explosive, such as PBXN-5. In some other embodiments, energetic payload 426 is an incendiary material, such as thermite. In yet some further embodiments, energetic payload 426 is a reactive composition, such as a thermite-like composition of two or more nonexplosive solid materials that remain inert and do not react with one another until subjected to a sufficiently strong stimulus.

In the illustrative embodiment, electronic payload 428 is electronic safe and arm electronics, such as an electronic safe-arm and fire device (ESAF). Some embodiments of an ESAF suitable for use in conjunction with SCR 104 are described in applicant's co-pending U.S. patent application Ser. No. 16/732,659, incorporated herein by reference. In some other embodiments, electronic payload 428 is a programmable electronic delay/timer and devices for triggering energetic payload 426. Electronic payload 428 is discussed in further detail in conjunction with FIG. 6C.

FIG. 4 also depicts protuberance 316, referenced above, which is situated at the aft end of nose 206 for integration with body 210. Additionally, FIG. 4 depicts the manner, in the illustrative embodiment, in which parts 322 and 324 of cap 212 couple to one another.

An important aspect of SCR 104 is its ability to be remotely programmed; that is, programmed while physically inaccessible within the barrel or loader of a weapon. In the illustrative embodiment, SCR 104 does not contain wireless communications capability, as a consequence of its severe space constraints. Consequently, to receive programming and/or other communications signals, SCR 104 must be electrically coupled to its external environment via wires, etc., up until the time it is fired.

Figure 5:
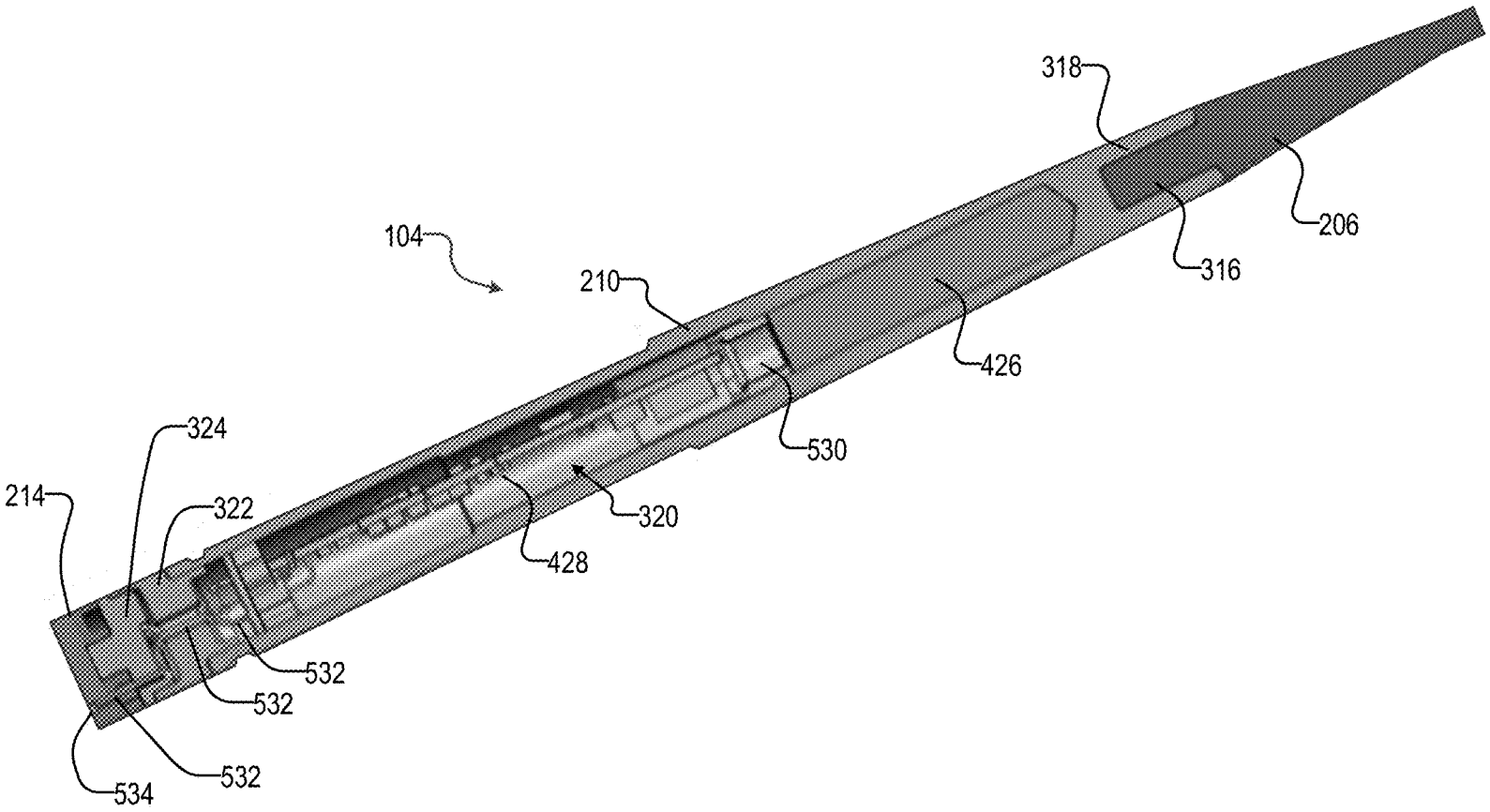
FIG. 5 depicts additional details of the cross-sectional view of FIG. 3.

FIG. 5 depicts a cross sectional view of the internal components of SCR 104 depicted in FIG. 4. As depicted in FIG. 5, energetic payload 426 is disposed in the forward portion of payload compartment 320 and electronic payload 428 is disposed in the aft portion thereof. In embodiments in which electronic payload 428 is an ESAF, when appropriate conditions (i.e., safety and operational) are satisfied, a high voltage pulse delivered by the ESAF triggers explosive foil initiator (EFI) 530. The EFI, in turn, triggers energetic payload 426. For various tactical reasons, once the EFI triggers, it is advantageous to have a time delay before the energetic payload is triggered. In accordance with embodiments of the invention, that delay is programmable while SCR 104 is in the barrel or loader of the weapon from which it's fired. This enables SCR 104 to be programmed based on late-acquired target intelligence.

Wires 532 pass through cap insulator 214 and parts 324 and 322 of cap 212. Such wires couple electrical contact pads 534 (only one is depicted in FIG. 5 for clarity) at the aft end of cap insulator 210 to electronic payload 428. As discussed further in conjunction with FIGS. 6A and 6B, it is via this electrically pathway that signals pass to and from SCR 104.

As described in Ser. No. 16/732,659, previously referenced, when SCR 104 is in the barrel of the weapon prior to launch, it is in contact with a cable mandrel that is not part of SCR 104 proper, and which remains in the barrel of the weapon after firing. More particularly, electrical spring contacts that extend from the cable mandrel are in physical contact with electrical contact pads 534 of cap insulator 214. The spring contacts are electrically coupled to a controller and/or other electronics on-board the weapon platform (UUV, etc.). This arrangement places SCR 104 in electrical communication with external electronics to facilitate remote programming/signaling.

Figure 6C:
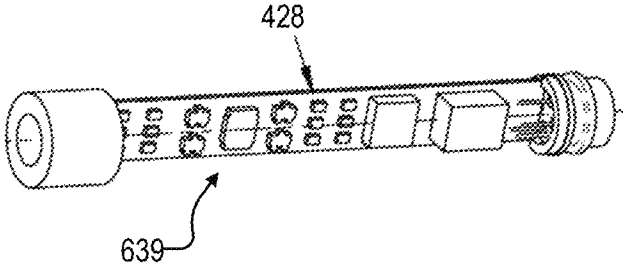
FIG. 6C depicts an embodiment of an electronic payload of the supercavitating cargo round.
Figure 6B:
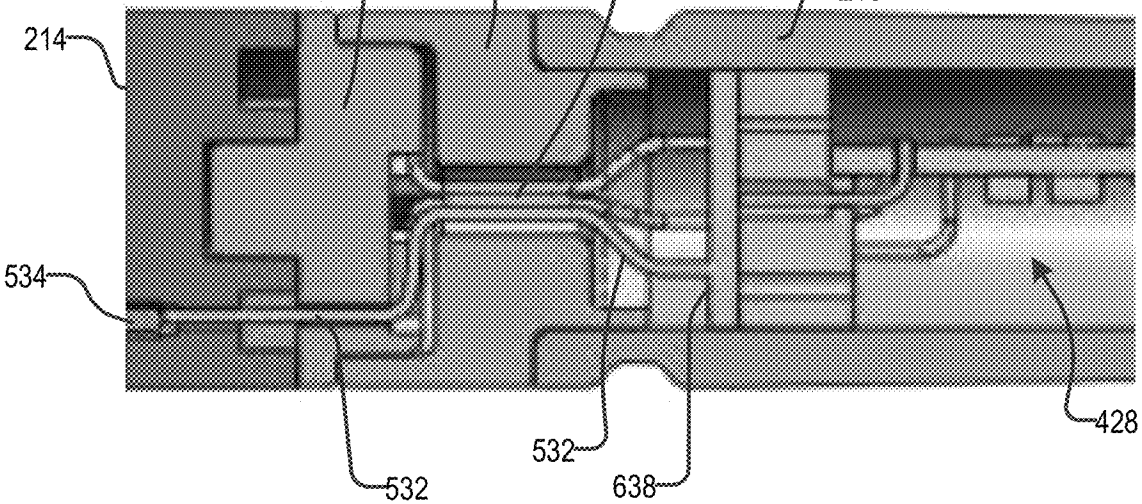
FIG. 6B depicts an enlargement of the cross-sectional view of FIG. 5, showing the aft end of the supercavitating cargo round.
Figure 6A:
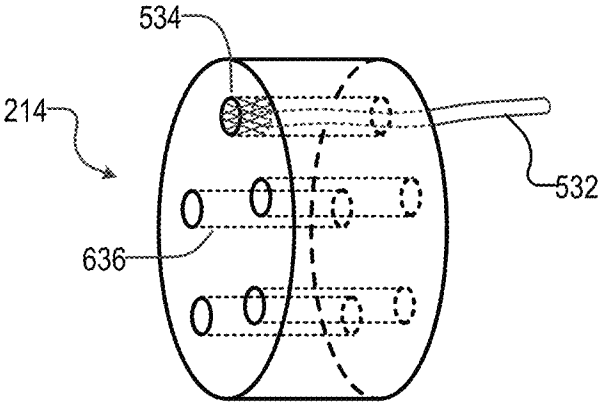
FIG. 6A depicts an embodiment of a cap insulator of the supercavitating cargo round of FIG. 2.

FIG. 6A depicts further detail of cap insulator 214. In the illustrative embodiment, cap insulator 214 comprises five vias 636. The end of each via 636 nearest the aft-facing surface of cap insulator 214 is coated with an electrically conductive material, such as copper, to form electrical contact pads 534. Wire 532 is disposed in each via 636, and is electrically connected (e.g., soldered, etc.) to an associated contact pad 534.

FIG. 6B depicts a cross-sectional view of cap insulator 214, second part 324 and first part 322 of cap 212, and a portion of electronics payload 428. This Figure shows wire(s) 532 passing through first and second parts 322 and 324 of the cap, connecting at one end to electrical contact pad(s) 534, and at their other end to aft end 638 of electronics payload 428.

FIG. 6C depicts electronics payload 428. As previously disclosed, in some embodiments, electronics payload 428 comprises a safe-and-arm device, such as an ESAF. In some of such embodiments, the ESAF includes discrete electronics 639, such as a high-voltage capacitor, and a high-voltage switch, digital-delay timer circuits, counters, clocks, discrete logic circuits, accelerometers, and the like (see, e.g., Ser. No. 16/732,659). Such circuitry and devices facilitate implementing requisite safety requirements, programming, triggering mechanisms, and triggering delays. In some other embodiments, the electronic payload is not a safe-and-arm device, but rather includes discrete electronics 639 for supporting programming (memory, logic circuitry, etc.), counters, clocks, and a triggering mechanism for energetic payload 426.

Figure 7A:
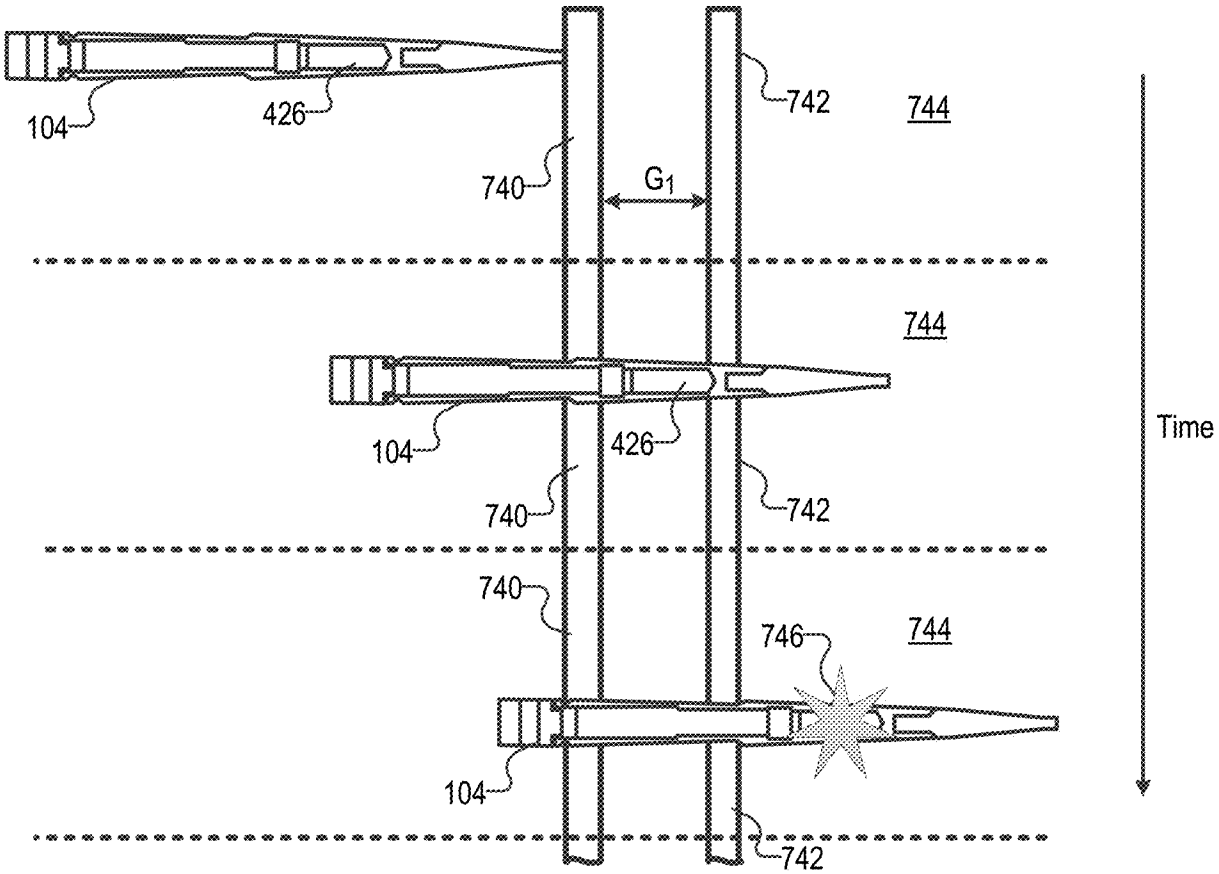
FIGS. 7A and 7B depict an example of a conops for a supercavitating cargo round in accordance with the present invention.
Figure 7B:
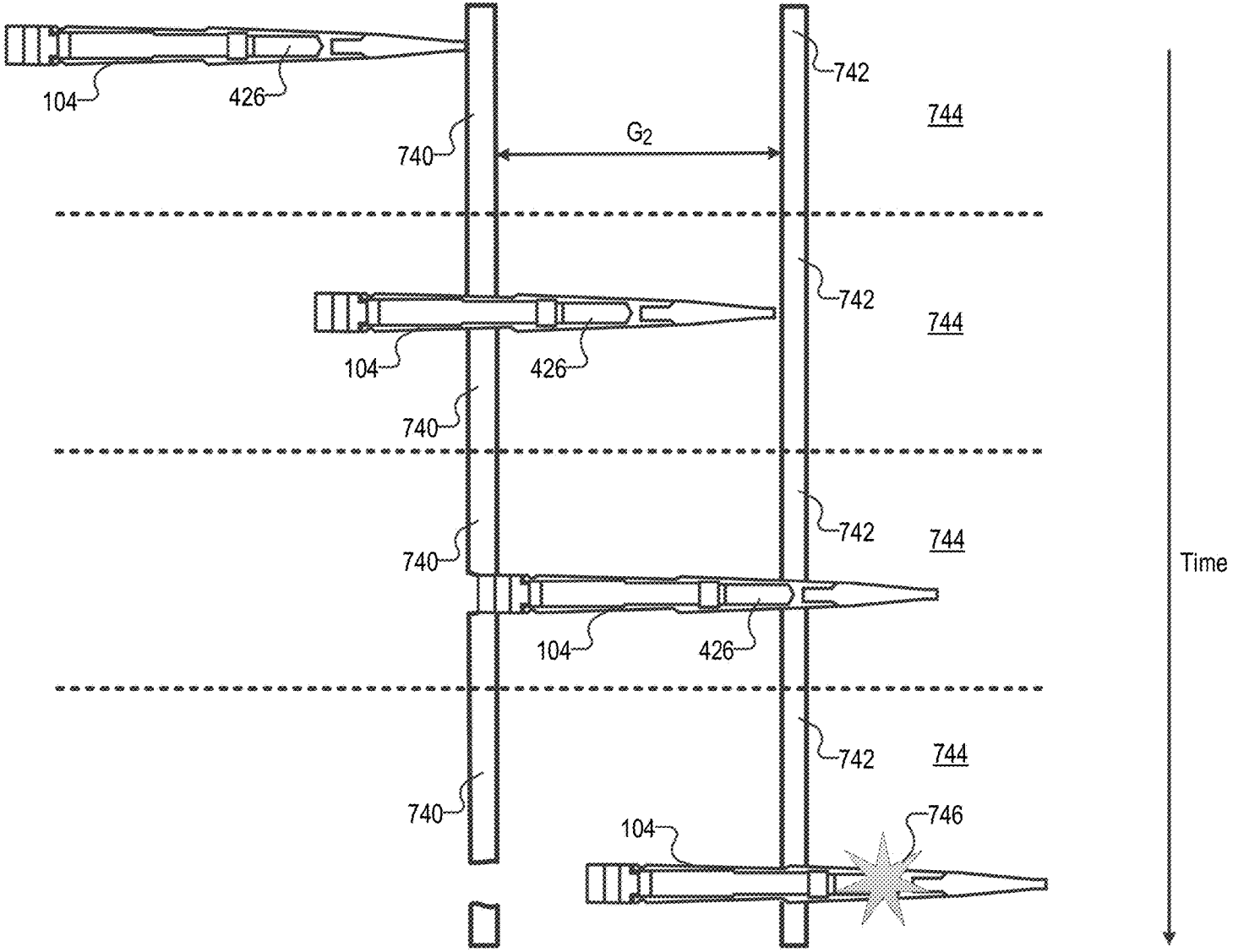

FIGS. 7A and 7B depict an example of the mission flexibility provided by embodiments of a supercavitating cargo round in accordance with the present teachings. FIG. 7A depicts a first scenario in which SCR 104 impacts a first mine having an outer casing 740, and inner casing 742, and high explosive 744, wherein the inner and outer casing are separated by an air gap $G_1$. FIG. 7B depicts a second scenario in which SCR 104 impacts a second mine having an outer casing 740, and inner casing 742, and high explosive 744, wherein the inner and outer casing are separated by an air gap $G_2$. The air gap $G_2$ of the second mine is larger than the air gap $G_1$ of the first mine.

In either scenario, when SCR 104 impacts outer casing 740, a delay is triggered. The delay is intended to provide a sufficient amount of time for energetic payload 426 to embed in high-explosive 744 of the mines. Once the delay elapses, energetic payload 426 is triggered, which will in turn trigger high-explosive 744 and destroy the mine. As a consequence of the different size gaps $G_1$ and $G_2$, the triggering delay must be different for these two scenarios. By virtue of the "in-the-barrel" programming capability of SCR 104, an appropriate delay can be programmed into SCR 104 at any time prior to its firing. In the scenarios presented in FIGS. 7A and 7B, late-acquired intelligence about the nature of the mine can be used to set a delay that is appropriate for whichever of the gaps $G_1$ and $G_2$ SCR 104 traverses on engagement.

In another set of scenarios, the air gap between the casings of each mine is the same, but the thickness of the mine casings is different. If launched with the same muzzle velocity and positioned at the same stand-off distance when fired, the mine having the thicker casing would result in greater deceleration of SCR 104 on impact, thus requiring more time for the round to penetrate to high-explosive 744 therein. Once again, a supercavitating cargo round in accordance with the present teachings can be programmed up until the time it is fired, and can therefore take advantage of intelligence about the mine that is not obtained until shortly before engagement.

There may be scenarios, such as those discussed above, wherein energetic payload 426 is intended to be implanted inside a target. In such missions, energetic payload 426 is detonated/ignited only after implantation. Implantation must therefore occur without damage to energetic payload 426, among any other components of SCR 104. To reliably accomplish this, the inventors recognized that SCR 104 must meet several requirements.

One such requirement is that nose 206, in addition to physical adaptation(s) for facilitating supercavitation, must be sufficiently robust to function as a "penetrator" to penetrate the hull of the target, be it a mine casing, a vessel, etc.

A second requirement is that payload compartment 320, and the payloads (i.e., electronic payload 428 and energetic payload 426) themselves, must be designed to survive axial and radial bending loads. In conjunction with other requirements discussed below, this prevents compromising the payload, such as electronic-component separation or circuitry degradation as the target's hull is penetrated by SCR 104. These axial and radial bending loads become significant design considerations for SCR 104 because, in addition to target-penetration considerations, SCR 104 must remain stiff during water penetration to reduce drag and protect the payload. Also, if SCR 104 were to bend under extreme hydrodynamic loads, such as might be caused by a few degrees of yaw (and at high speed), its trajectory will deviate.

A third requirement is that energetic payload 426, for many engagements, must be arrested inside the target, as opposed to passing completely through it. This is complicated by the constraint that SCR 104 must be supercavitating until terminal impact, which necessarily requires traveling at the relatively high velocities necessary for supercavitation.

The mechanical-engineering design of SCR 104 is driven by the intended muzzle velocity and terminal impact velocity of the cargo round, as well its caliber. The relatively long length of SCR 104, which requires a relatively long vapor cavity, constrains muzzle velocities to the highest possible in order for it to supercavitate for a useful distance.

The inventors recognized that the third requirement could be facilitated by engineering SCR 104 so that nose 206 separates from body 210 during impact with a target. As previously disclosed, this separation is implemented in the illustrative embodiment by coupling nose 206 and body 210 to one another via a press fit (and/or optionally a weak adhesive).

More particularly, when SCR 104 is fired, the ensuing acceleration forces body 210 against nose 206. Then, during supercavitating transit, the drag force upon the tip of nose 206 (cavitator 208) transfers deceleration forces to body 210, thereby keeping the body and nose together. As SCR 104 impacts a target, nose 206 is first to penetrate. Body 210, which is wider and less massive than nose 206, widens the "hole" in the target formed by nose 206. This results in a drag force on body 210, slowing it. As a consequence, the very dense nose 206 separates from body 210, continuing forward through the target. In addition to a net loss in momentum, this separation causes the center-of-gravity of the now nose-less SCR 104 to shift rearward, which tends to destabilize the movement of body. This further increases drag on the body. In combination, these effects substantially slow body 210 and impede its forward progress, causing it, and its accompanying energetic payload, to arrest in the target.

In scenarios in which the target is a mine, the inventors have discovered an ancillary benefit to separating nose 206 from body 210. Specifically, as nose 206 passes through the mine, it disrupts the high-explosive material therein, but does not possess sufficient energy to initiate an explosion. Such disruption has been found to facilitate the subsequent destruction of the mine when energetic payload 426 within body 210 ignites.

Example

In the illustrative embodiment, SCR 104 has the following dimensions:

| Body 210 | |
|---|---|
| Max Diameter: | 20.7 mm |
| Min Diameter: | 14.0 mm |
| Total Length: | 194 mm |
| Distance from forward edge to point of maximum diameter: | 102 mm |
| Taper from forward edge to point of maximum diameter: | 1.9 degrees |
| Taper from point of step change in diameter to aft end: | 1.1 degrees |
| Length of payload compartment: | 168 mm |
| Diameter of payload compartment (for energetic payload): | 10.7 mm |
| Max Diameter of payload compartment (electronic payload): | 14.3 mm |
| Min Diameter of payload compartment (electronic payload): | 12.7 mm |
| Max Wall thickness: | 4.5 mm |
| Min Wall thickness: | 2.6 mm |

| Nose 206 | |
|---|---|
| Length: | 50.8 mm |
| Diameter of cavitator: | 2-10 mm |
| Max Diameter: | 14.0 mm |

The design (e.g., dimensions, surface contours, etc.) of a supercavitating cargo round is a function of many factors, including, without limitations, its intended operating depth, its intended velocity, and the weight of its payload. The illustrative embodiment of the invention—SCR 104—has a diameter of approximately 20 mm and carries a payload of 8.3 grams of PBXN-5. Attributes of its shape, including the precise contours of its surface, variations in diameter along its length, the ratio of the length of the nose to the length of body, and the round's total length, are unique. It is within the capabilities of those skilled in the art, in conjunction with the present disclosure, to design and build a supercavitating cargo round in accordance with the present invention, as a function of its desired operational characteristics. Although some aspects of the design can be deduced from first principles, some are based on empirical relations, as determined from trial-and-error testing.

Any one of several references, such as, for example, "Forces on Composite Bodies in Full Cavity Flow," by R. L. Waid (California Inst. Tech., Report No. E-73.8, September 1957), present equations that can be used to design a supercavitating projectile. Such equations will provide interrelationships between parameters such as ambient pressure, projectile velocity, tip diameter, projectile diameter, and projectile length. They can be used, for example, to examine the impact of ambient (water) pressure on projectile design (e.g., geometry, and velocity vs. range). One skilled in the art will be able to code the appropriate equations into, for example, MatLab and Excel spreadsheets to address the parameter space (i.e., ambient pressure, projectile velocity, tip diameter, projectile diameter, projectile length), such as to predict drag force and the size of the resulting vapor cavity. Moreover, equations are available that account for the effects of the pitch or yaw of the projectile.

Figure 8:
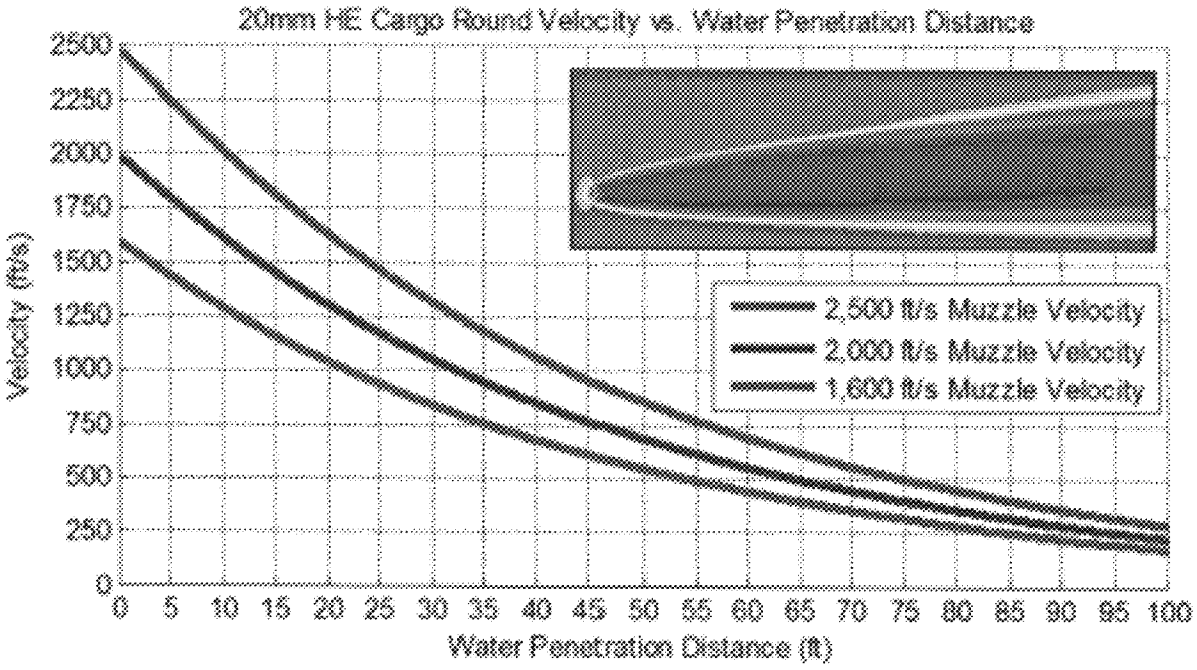
FIG. 8 depicts a plot of supercavitating cargo round velocity versus water penetration distance.
Figure 9:
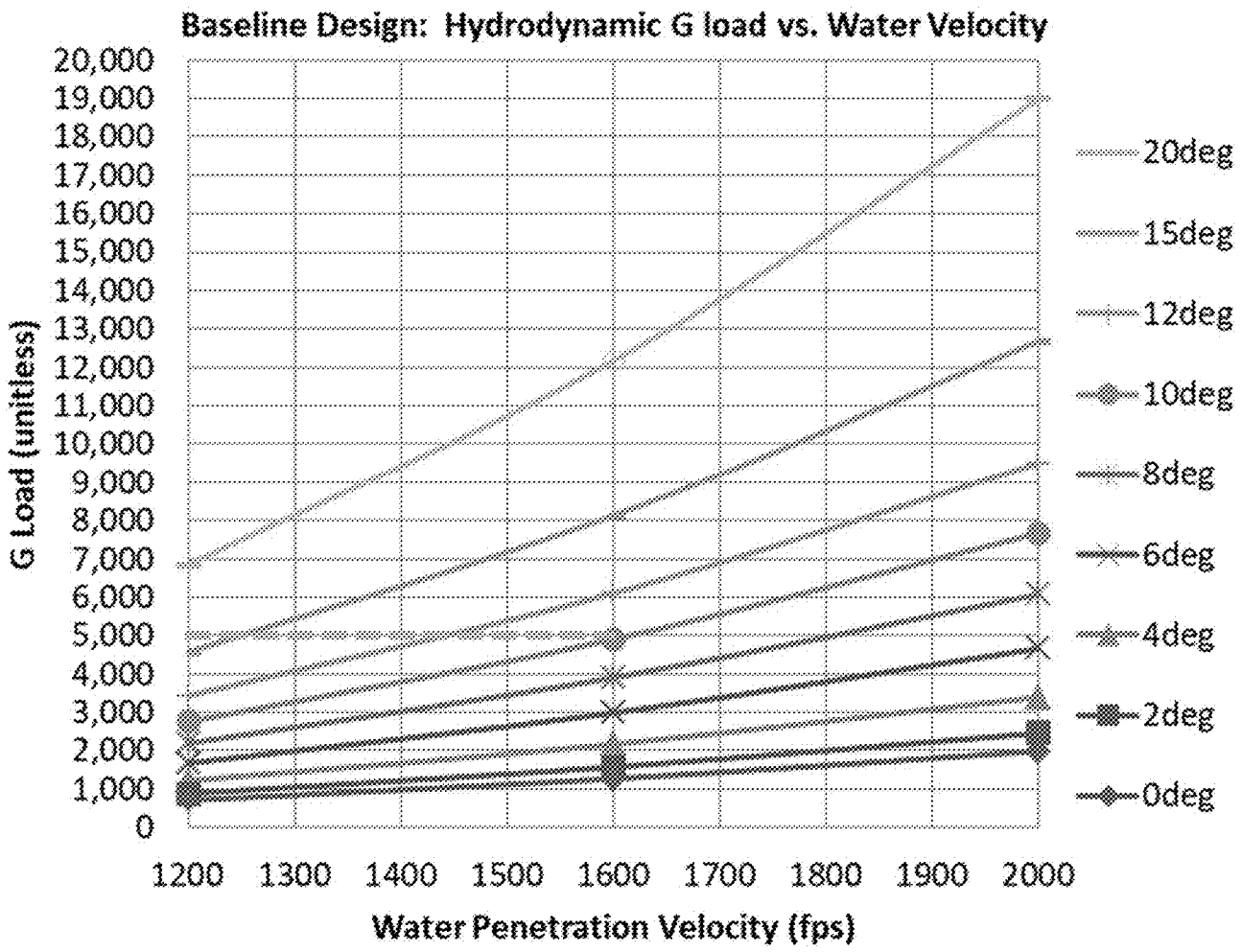
FIG. 9 depicts a plot of hydrodynamic G load versus water velocity as a function of angle-of-attack.
Figure 10:
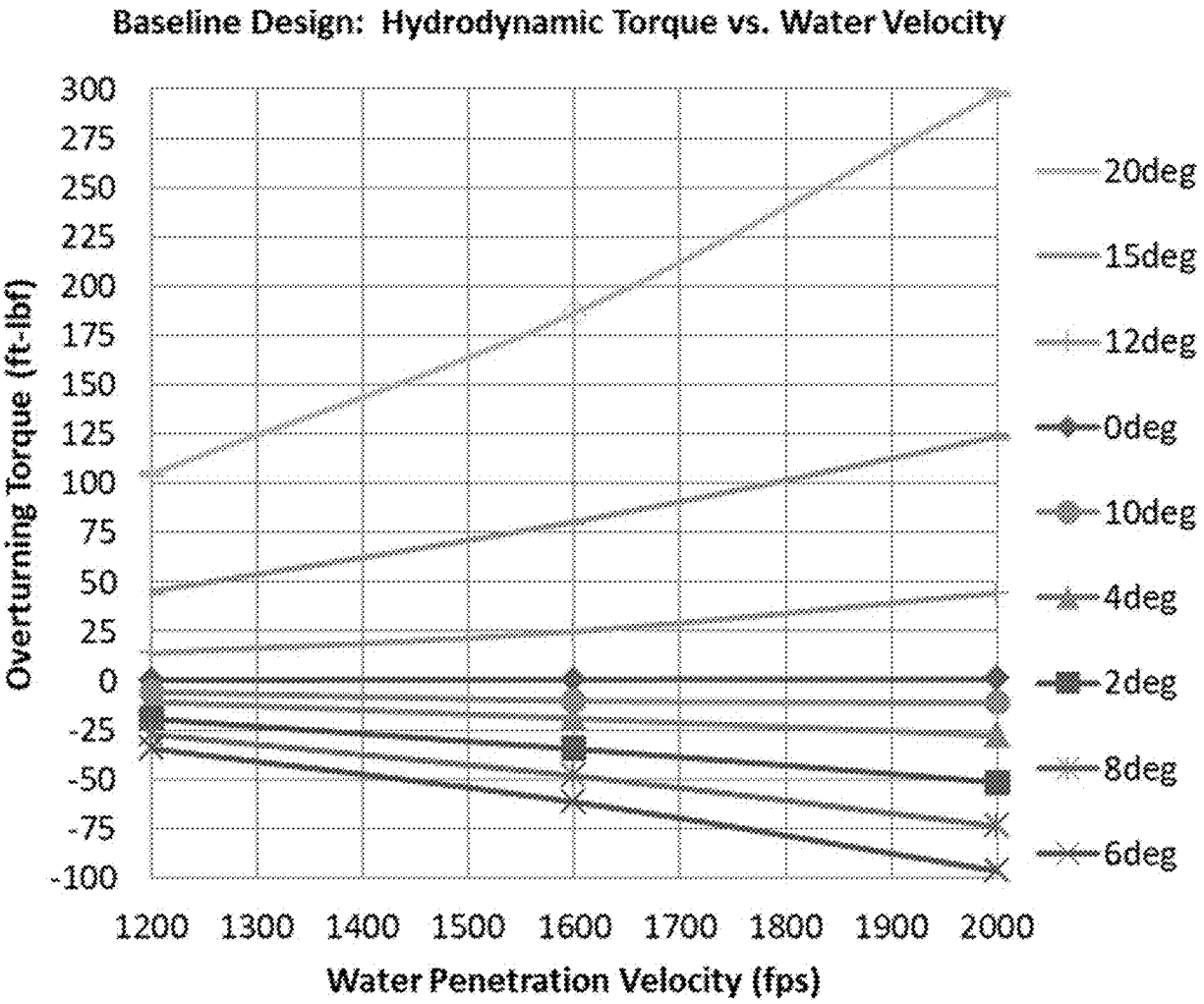
FIG. 10 depicts a plot of hydrodynamic torque versus water velocity as a function of angle-of-attack.

FIGS. 8-10 present simulation results for the illustrative embodiment of a 20 mm supercavitating cargo round. FIG. 8 depicts water penetration distance as a function of muzzle velocity in shallow water (down to 30 feet depths). Plots are depicted for muzzle velocities of 2500 ft/sec, 2000 ft/sec, and 1600 ft/sec. Additional modeling of a 20 mm cargo round showed stability at angles-of-attack in the range of 0° to 7°. Simulations suggest that a SCR traveling at 1,600 fps provides sufficient energy to completely penetrate steel plate having a thickness of 0.5 inches for angles-of-attack of up to 5°. For 2,500 ft/s and 2,000 ft/s muzzles velocities, the maximum estimated underwater standoff-distance to completely penetrate steel plate having a thickness of 0.5 inches are 10 feet and 20 feet, respectively. Thinner targets can be penetrated at greater distances. For example, actual testing showed that at a shallow depth, a 20 mm SCR maintained structural integrity after completely penetrating a steel plate having a thickness of 0.25 inches from a standoff distance of 30 feet.

FIG. 9 presents a simulation of the hydrodynamic g-load of a 20 mm supercavitating cargo round as a function of water penetration velocity and angle-of-attack. The simulation shows that water-penetration drag load can exceed 5,000 G between 10° to 15° angle-of-attack. This shows that if a delay timer is to be triggered upon terminal ballistic impact (e.g., to provide time for the SCR to penetrate a target, etc.), the g-switch that triggers the timer must trigger at a sufficiently high g-force to reliably distinguish between water penetration g-load and the g-load experienced during terminal ballistic impact.

FIG. 10 depicts a simulation of hydrodynamic torque versus water velocity for a 20 mm supercavitating cargo round as a function of angle-of-attack. The simulation shows that the SCR is stable underwater at an angle-of-attack in the range of 0° to 10°.

It is to be understood that the disclosure describes a few embodiments and that many variations of the invention can easily be devised by those skilled in the art after reading this disclosure and that the scope of the present invention is to be determined by the following claims.

What is claimed:

1. A supercavitating cargo round, the supercavitating cargo round comprising:

a body, the body having an aft end, a forward end, and a long axis defined therebetween, the body containing a payload compartment;

a nose physically coupled to the forward end of the body, a forward end of the nose terminating in a flat surface that is orthogonal to the long axis of the body, the flat surface dimensioned to function as a cavitator when the supercavitating cargo round moves at sufficient velocity in water;

an energetic payload, wherein the energetic payload is disposed in the payload compartment;

an electronic payload, wherein the electronic payload is disposed in the payload compartment aft of the energetic payload, and wherein the electronic payload comprises a processor, electronics for implementing a digital delay or timing circuit, and a device for triggering the energetic payload;

a cap for sealing the aft end of the body;

a cap insulator that physically couples, at a forward surface thereof, to the cap, the cap insulator comprising an electrically insulating material, and wherein the cap insulator comprises a plurality of vias extending therethrough, wherein a portion of each via proximal to an aft surface of the cap insulator comprises an electrically conductive material, the electrically conductive material forming electrical contact pads, and wherein the electrical contact pads form an electrical interface for receiving signals originating external to the supercavitating cargo round, wherein the signals comprise information for programming the processor; and a plurality of wires, one wire thereof passing through each via and coupled, at a first end thereof, to the electrical contact pad of the associated via, the plurality of wires passing through the cap and electrically coupled, at a second end thereof, to the electronic payload, the wires thereby conveying the signals received at the electrical contact pads to the electronic payload.

2. The supercavitating cargo round of claim 1, and further wherein the nose is physically adapted to decouple from the body during impact with a target.

3. The supercavitating cargo round of claim 1 wherein the body has a maximum diameter of about 20 millimeters.

4. The supercavitating cargo round of claim 1 wherein the electronic payload is a safe-arm and fire device.

5. The supercavitating cargo round of claim 1 wherein nose comprises an alloy having a tungsten content of at least about 90 weight percent.

6. The supercavitating cargo round of claim 1 wherein the energetic payload comprises high explosive.

7. The supercavitating cargo round of claim 1 wherein body comprises steel.

8. A supercavitating cargo round, the supercavitating cargo round comprising:

a body containing a payload compartment;

a nose physically coupled to the forward end of the body, a forward end of the nose comprising a cavitator for creating a vapor cavity when the supercavitating cargo round moves at sufficient velocity in water;

an energetic payload disposed in the payload compartment;

an electronic payload disposed in the payload compartment aft of the energetic payload, the electronic payload comprising programmable electronics, at least some of which is programmable, that trigger the energetic payload and delay the triggering of the energetic payload; and electrical contacts for receiving electrical signals originating external to the supercavitating round while in a barrel or loader from which the supercavitating cargo round is fired; and electrical conductors that conduct the electrical signals from the electrical contacts to the electronic payload, the electrical signals suitable for programming the programmable electronics.

9. The supercavitating cargo round of claim 8 wherein the energetic payload comprises high explosive.

10. The supercavitating cargo round of claim 8 wherein the electronic payload comprises safe-and-arm electronics.

11. The supercavitating cargo round of claim 8 wherein the electronic payload comprises a programmable digital delay.

12. The supercavitating cargo round of claim 8, wherein the nose is physically adapted to separate from the body during impact with a target.

13. The supercavitating cargo round of claim 8 wherein the body has an aft end, wherein the aft end includes one or more hydrodynamic-stability-enhancing physical adaptations.

14. The supercavitating cargo round of claim 8 wherein the body has an aft end, wherein the aft end includes one or more physical adaptation that facilitate arresting the energetic payload within a target.

15. The supercavitating cargo round of claim 8 wherein the energetic payload is selected from the group consisting of high explosive, incendiary material, and a reactive composition.

16. The supercavitating cargo round of claim 8 wherein the nose is not adhered to the body.

17. The supercavitating cargo round of claim 8 wherein the delay is for an arbitrarily long length of time of at least one hour.

18. The supercavitating cargo round of claim 8 wherein the delay is for a sufficient length of time to enable the energetic payload to penetrate an inner casing or hull of a target.

19. The supercavitating cargo round of claim 8 wherein the body has a maximum diameter of about 20 millimeters.

20. The supercavitating cargo round of claim 8 wherein the electronics that delay the triggering of the energetic payload comprises a delay timer, the supercavitating cargo round comprising a g-switch for triggering the delay timer, wherein the g-switch triggers the delay timer only when it registers a g-load (i) in excess of a maximum g-load expected as the supercavitating cargo round penetrates water, and (ii) having a magnitude indicative of terminal ballistic impact with a target.

* * * * *